US007097740B2

(12) United States Patent
Vuorinen

(10) Patent No.: US 7,097,740 B2
(45) Date of Patent: Aug. 29, 2006

(54) METHOD AND SCREEN FOR SCREENING AT LEAST TWO PULP MIXTURES

(75) Inventor: Timo Vuorinen, Tampere (FI)

(73) Assignee: Metso Paper Inc., Helsinki (FI)

( * ) Notice: Subject to any disclaimer, the term of this patent is extended or adjusted under 35 U.S.C. 154(b) by 393 days.

(21) Appl. No.: 10/411,400

(22) Filed: Apr. 10, 2003

(65) Prior Publication Data

US 2004/0007337 A1 Jan. 15, 2004

Related U.S. Application Data

(63) Continuation of application No. PCT/FI01/00906, filed on Oct. 18, 2001.

(30) Foreign Application Priority Data

Oct. 20, 2000 (FI) ..... 20002317

(51) Int. Cl.
*D21C 7/14* (2006.01)

(52) U.S. Cl. ..... 162/243; 162/55; 162/56; 162/57; 162/65; 162/251; 209/17; 209/270; 209/306; 210/414; 210/415; 366/103

(58) Field of Classification Search ..... 162/55, 162/251, 57, 65–68, 243; 209/17, 270, 306; 210/414, 415; 366/103, 303
See application file for complete search history.

(56) References Cited

U.S. PATENT DOCUMENTS 1,183,298 A * 5/1916 Haug ..... 209/270

FOREIGN PATENT DOCUMENTS

| | | |
|---|---|---|
| GB | 1 374 358 | 11/1974 |
| WO | WO 00/58549 | 10/2000 |

* cited by examiner

*Primary Examiner*—Mark Halpern
(74) *Attorney, Agent, or Firm*—Alston & Bird LLP

(57) ABSTRACT

The invention relates to a method and a screen for screening two or more pulp mixtures with different roughness. The screen comprises a first screen cylinder and a second screen cylinder. A coarse first pulp mixture is fed into the inlet end of the first screen cylinder, and a second, less coarse pulp mixture is supplied to the second screen cylinder. The pulp mixtures are screened by means of a screen surface of the screen cylinders into accept that passes apertures provided in the screen surface and reject that does not pass the apertures. The accept from the second cylinder is conveyed by means of a guide tube provided between the cylinders towards the inlet end of the first cylinder and it is finally mixed with the first pulp mixture. The accept from the first and the second pulp mixture passes the screen surface of the first screen cylinder.

15 Claims, 3 Drawing Sheets

METHOD AND SCREEN FOR SCREENING AT LEAST TWO PULP MIXTURES

CROSS-REFERENCE TO RELATED APPLICATIONS

This application is a Continuation of International Application PCT/FI01/00906; filed 18 Oct. 2001, which designated the U.S. and was published under PCT Article 21(2) in English, which is incorporated herein in its entirety by reference.

BACKGROUND OF THE INVENTION

1. Field of the Invention

The invention relates to a method for screening pulp mixtures with different roughness, which method comprises feeding a pulp mixture to be screened into a screen cylinder from an inlet end of the cylinder, and rotating the screen cylinder around its longitudinal axis during the screening, the pulp being thus screened by means of a screen surface provided with apertures, such that the accepted pulp fraction, or accept, is able to pass the apertures in the screen surface and the rejected fraction, or reject, is conveyed to the opposite or discharge end of the screen cylinder where it is removed from the screen.

2. Field of the Invention

The invention further relates to a screen comprising a screen cylinder arranged to be rotated around its longitudinal axis by a rotator, the inlet end of the screen cylinder comprising a feed pipe for feeding a pulp mixture into the screen cylinder, the circumference of the screen cylinder forming a screen surface, which is provided with apertures of a predetermined size for screening the pulp into an accepted fraction, or accept, that passes said apertures and a rejected fraction, or reject, that does not pass the apertures, the inner circumference of the screen cylinder being provided with conveying means for conveying the reject to the discharge end of the screen cylinder as the cylinder is rotated, the screen comprising a recovery basin for recovering the accept.

3. Description of Related Art

Manufacture of paper includes removal of impurities from pulp and screening of fibre mixtures with different roughness. For example processing of recycled fibre provides pulp mixtures with different roughness consisting primarily of water and fibres, and the mixtures are further processed by screens in order to recover the desired accepted fibre fraction, or accept, and to remove the rejected fraction, or reject. The reject can be conducted for reprocessing or it can be discharged entirely from the process. Pulp mixtures with different roughness have presently their own screens. Screens typically comprise a screen cylinder arranged rotatably around the longitudinal axis, and the pulp to be screened is fed into the cylinder. The circumference of the screen cylinder is provided with apertures forming a screen surface. Depending on the structure the apertures of the screen surface are either holes or slots. During screening the cylinder is rotated and the accepted part of the pulp passes the apertures in the screen surface and is thereafter recovered into a recovery basin and conducted further to subsequent process steps. The material that does not fit through the apertures constitutes the reject, which is supplied inside the cylinder to the discharge end and finally removed therefrom. A problem with the presently used arrangements is that pulp mixtures with different roughness require separate screens.

Several screens are naturally expensive to acquire and use and they also require a great deal of space in production plants.

BRIEF SUMMARY OF THE INVENTION

The purpose of the present invention is to provide a new and improved method and screen for screening at least two pulp mixtures with different roughness.

The method according to the invention is characterized by utilizing at least two screen cylinders for the screening by feeding a first, more coarse pulp mixture into a first screen cylinder and a second, less coarse pulp mixture into a second screen cylinder, by rotating the first and the second screen cylinder together around the axis of the first screen cylinder during the screening, conducting the accept that passed the screen surface of the second screen cylinder, by means of a guide tube arranged between the first and the second screen cylinder, a predetermined distance towards the inlet end of the first cylinder, and mixing the accept from the second cylinder with the first pulp mixture, the accept from the first and the second pulp mixture passing the screen surface of the first screen cylinder, followed by gathering all the accept to a common recovery basin, and conducting the reject removed from the first and the second pulp mixtures to the discharge end of the screen separately inside each screen cylinder.

Further, the screen according to the invention is characterized in that the screen comprises a first screen cylinder for screening coarse pulp and a second screen cylinder for screening less coarse pulp, that said screen cylinders are arranged coaxially to rotate together around the axis of the first screen cylinder, that between the first and the second screen cylinder there is a guide tube, which extends a certain distance from the discharge end of the second screen cylinder towards the inlet end of the first screen cylinder, the guide tube being arranged to conduct the accept that passed the second screen cylinder towards the inlet end of the first screen cylinder, and to allow said accept to be mixed with the first pulp mixture.

A basic idea of the invention is that the screen comprises at least two screen cylinders, i.e. a first and a second cylinder. The circumference of each screen cylinder constitutes a screen surface for screening pulp. The front end of the screen comprises an inlet end of the first cylinder, via which the first pulp mixture to be screened is fed into the cylinder. Correspondingly, the opposite end of the cylinder comprises an open discharge end for discharging the reject. The first and the second screen cylinder are rotated together by a single actuator around the axis of the first cylinder. The cylinders are preferably coaxial. A second pulp mixture, which is less coarse than the first mixture, is fed into the second cylinder. Thus, the first pulp mixture is preferably a coarse mixture and the second pulp mixture is a medium coarse mixture. The second pulp mixture is fed into the front of the second cylinder to the inlet end thereof, from which the pulp slowly flows towards the discharge end, aided by the rotational movement of the cylinder and by conveying means provided on the inner circumference of the cylinder, and the accepted fraction simultaneously passes the apertures on the screen surface of the cylinder. The front end of the second cylinder is closed and correspondingly the rear end is open. The screen further comprises a guide tube, which conveys the accept that passed the second cylinder towards the front of the screen. Finally, the accept from the second cylinder is conveyed to the first cylinder to be mixed with the first pulp mixture contained therein. The guide tube preferably conducts the accept separated from the second pulp mixture towards the front end of the first cylinder since it is easier to screen the pulp mixture at the front when it is still wet and the relative amount of reject is smaller than at the discharge end of the cylinder. Furthermore, since the apertures in the first cylinder intended for screening the first, more coarse pulp mixture are larger than those in the second cylinder, the accept from the second cylinder passes easily the screen surface of the first cylinder. After the accepted fractions screened from the first and the second pulp mixture have passed the first cylinder, they are collected into a common recovery basin and conducted further to subsequent process steps. The rejected fractions which do not pass the screen surfaces are guided separately within each cylinder into the discharge end and conducted for reprocessing or removed entirely from the process.

An advantage of the present invention over the use of several separate screens is that a single rotator is now able to simultaneously drive two or more screen cylinders. Also, the frame structure of the screen and the required auxiliary devices can be common to all the screens, which provides a simpler screen that is less expensive to manufacture. Furthermore, the accepted fractions of the less coarse and the coarse pulp mixture can be mixed together and, correspondingly, the rejected fractions can be admixed, so that both can be conducted further from the screen by means of a far more simple tube system than previously. Another feature that further simplifies the structure is that the cylinders placed one within the other may share an accept recovery basin and a chamber provided at the discharge end for collecting the reject. In conclusion, the screen according to the invention has lower costs of manufacture and use than two separate screens. Naturally the combined screen according to the invention is easier to actually install in a production plant since it takes up considerably less space and the required electrical and pipe connections are easier to install.

Furthermore, the basic idea of a preferred embodiment of the invention is that the screen cylinders are arranged at least partly one within the other. Such a construction requires only a little space, and it is easy to drive the cylinders by one actuator.

The basic idea of another preferred embodiment of the invention is that the second screen cylinder of a smaller diameter is arranged inside the first screen cylinder at the discharge end thereof, and that the second screen cylinder extends a certain distance from the discharge end of the first cylinder towards the inlet end. The front end of the second screen cylinder thus rests on the inner circumference of the first screen cylinder. Such a construction is advantageous when the amount of the medium coarse pulp mixture supplied to the screening is smaller than the amount of the coarse pulp mixture.

The basic idea of a third preferred embodiment of the invention is that at least the outer circumference of the guide tube is conical and expands towards the front of the screen. Due to the sloping surface of the cone's outer circumference the pulp mixture consisting mainly of reject at the end of the outer pipe flows more smoothly towards the discharge end.

BRIEF DESCRIPTION OF THE SEVERAL VIEWS OF THE DRAWINGS

The invention will be described in greater detail in the accompanying drawings, in which.

DETAILED DESCRIPTION OF THE INVENTION

Figure 1:
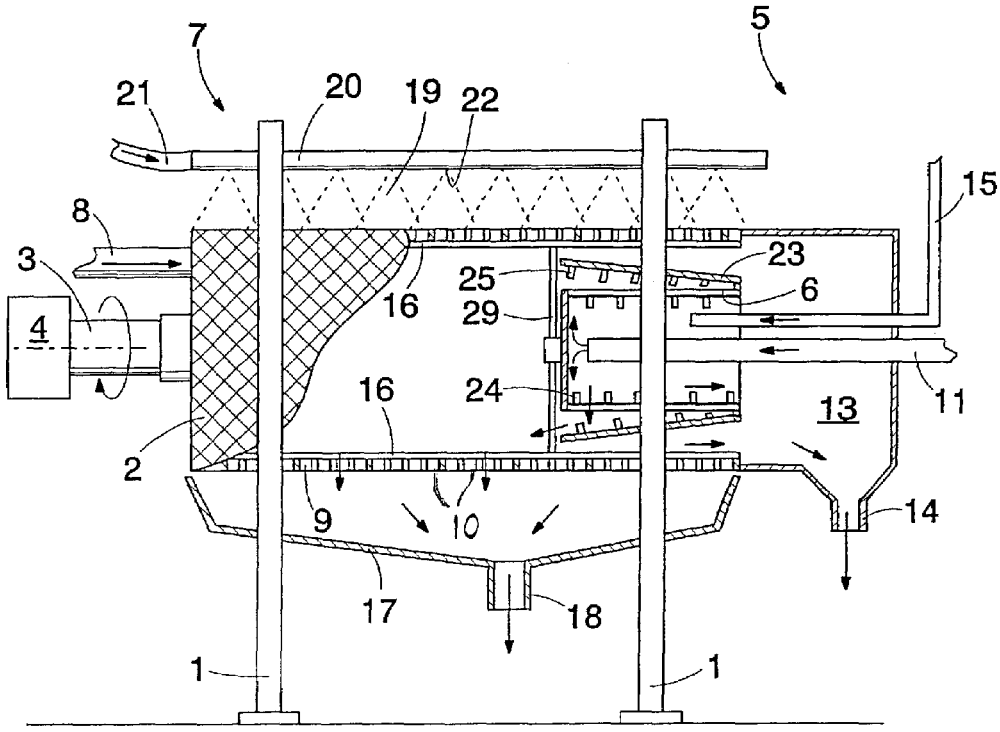
FIG. 1 is a schematic side view, in partial section, of a screen according to the invention.

Like reference numerals denote like elements in the figures. The arrows in the figures illustrate directions of flow.

Figure 4:
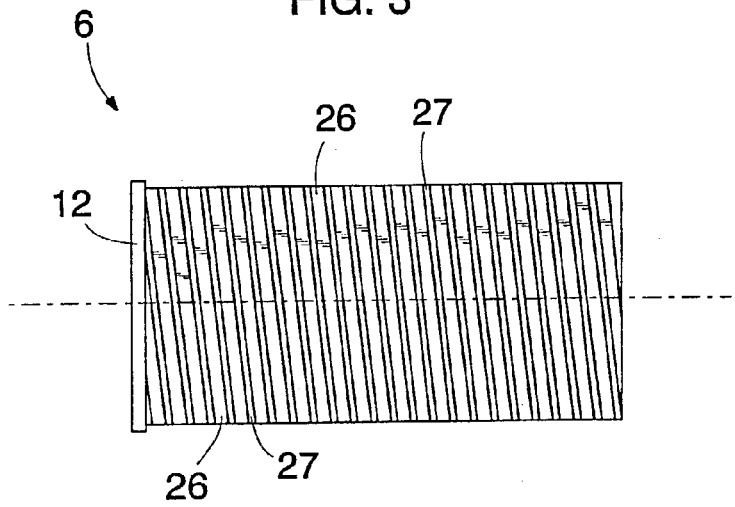
FIG. 4 is a schematic side view of an inner screen cylinder of the screen according to the invention.
Figure 5:
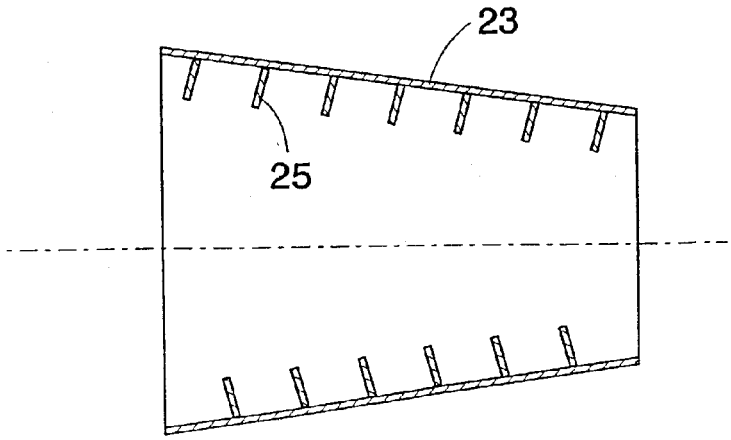
FIG. 5 shows schematically a sectional side view of a conical element of the screen according to the invention.

FIG. 1 shows a screen according to the invention in a simplified manner. The screen comprises a frame 1, which supports a first or outer cylinder 2 that is rotated around its longitudinal axis by means of driving force generated by a rotator 4 and supplied therefrom by a shaft 3. Alternatively, the cylinder can be rotated by means of a gear ring provided on the circumference thereof, by a belt drive, friction wheels or in some other suitable manner. In the figure, a second or inner cylinder 6 of a smaller diameter is provided inside the outer cylinder at the discharge or rear end 5 of the screen. The inner cylinder is shorter than the outer cylinder and extends a predetermined distance from the rear end 5 of the screen towards the input or front end 7 thereof. The outer cylinder is typically about four meters long and the inner cylinder is about one meter. The input or front ends of the cylinders are substantially closed and the discharge or rear ends are substantially open. Furthermore, between the outer and the inner cylinder there is a guide tube 23, which is preferably a conical element as shown in FIG. 5. The guide tube is preferably substantially coaxial with the screen cylinders and the same rotator 4 rotates it. A first pulp mixture is fed into the outer cylinder 2 via a first feed conduit 8 provided at the front end 7 of the screen, and the mixture is screened by a screen surface 9 formed on the circumference of the outer cylinder. The circumference of the outer cylinder is perforated by holes 10 of a predetermined size. Alternatively, it is possible to use a slotted screen, which is formed of a ribbon-like material by positioning several ribbons side by side and leaving slots of predetermined size between the parallel ribbons. The former cylinder provided with holes is advantageous in the large outer cylinder since it is easier to manufacture. As it is well known, in respect of its size the slotted cylinder formed of ribbons is more efficient in the screening of elongated fibres, and therefore it is advantageously used in the inner cylinder having smaller dimensions. It should also be noted that the amount of the less coarse pulp to be screened is usually smaller than that of the coarse pulp, which means that the smaller inner cylinder, which is very efficient, is able to easily screen a second pulp mixture comprising the less course pulp. FIG. 4 shows the structure of a slotted cylinder.

A pulp mixture supplied to the inlet end of the outer cylinder is conducted towards the discharge end 5 by means of substantially longitudinal conveying blades 16 arranged on the inner circumference of the cylinder. When the cylinder rotates, the conveying blades 16 lift the pulp from the bottom of the cylinder. Since the screen cylinder is arranged at a skew angle such that the rear end 5 of the cylinder is situated lower than the front end 7 thereof, the pulp always drops off the blades one step further towards the discharge end. The conveying blades also mix the pulp to be processed, thus preventing the formation of fibre bundles. The conveying blades can be replaced with a conveying spiral formed of bent ribbons on the inner circumference of the outer screen cylinder, or with some other conveyor device suitable for the purpose. While the pulp is being conveyed towards the discharge end of the cylinder, the material that has a particle size that is smaller than the apertures on the outer screen surface is able to pass the cylinder and flows down to an accept recovery basin 17 arranged below the cylinder, from which it is guided further along a duct 18. The reject that does not pass the screen surface of the outer screen cylinder flows to the discharge end of the cylinder, from which it is guided to a reject chamber 13 and further forward via a pipe 14 connected thereto.

During the screening the screen surface of the outer screen cylinder is cleaned by means of water sprays 19 substantially along the entire length of the cylinder. For this purpose a jet pipe 20 is arranged outside the outer cylinder, and rinsing water is supplied thereto from a water pipe 21 in order to be sprayed from nozzles 22 of the jet pipe over the outer circumference of the outer cylinder. The spray of water thus flushes the impurities stuck onto the apertures of the screen surface back into the cylinder. Some of the rinsing water is also able to flow into the outer cylinder, thus diluting the pulp mixture to be processed and improving the screening of the pulp.

Figure 2:
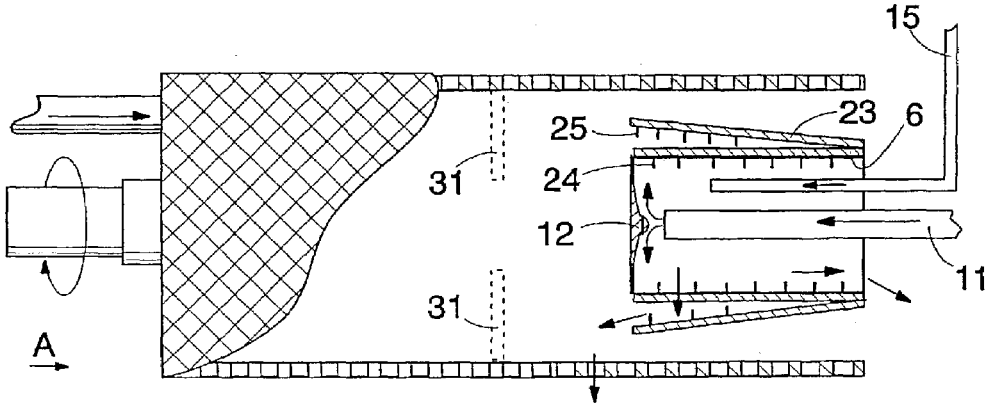
FIG. 2 is a schematic side view of the operating principle of a screen according to the invention.
Figure 7:
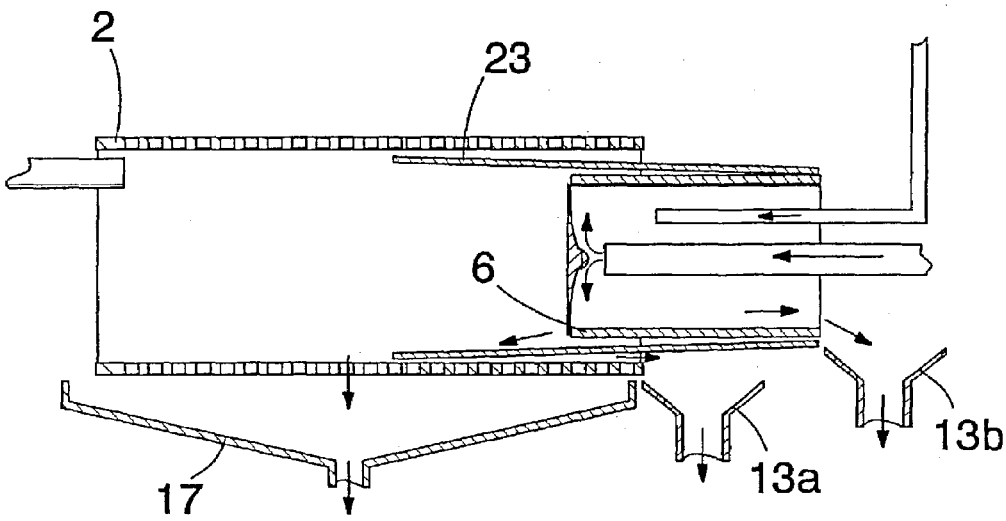

FIG. 2 shows in a simplified manner the structure of the screen shown in FIG. 1, and the arrows illustrate the flows of the pulp mixture fed into the inner screen cylinder. A second pulp mixture is fed into the inner cylinder via a second feed conduit 11, and it is preferably sprayed at a high pressure onto an end section 12 of the front end of the inner cylinder. Due to the pressure the pulp mixture spreads efficiently over the front end of the inner cylinder. The mixture is thus distributed over a larger area, which provides efficient screening. The end section 12 can be a straight plate as shown in FIG. 1, or it may be conical or shaped in some other manner that is advantageous for the flow, as illustrated in FIG. 2. The inner circumference of the inner cylinder comprises conveying means, such as a conveying spiral 24, which guides the pulp to be screened towards the discharge end as the cylinder rotates. Some of the pulp simultaneously passes the screen surface of the inner cylinder and flows into the inner circumference of the guide tube 23. The guide tube conveys the accept toward the front end of the screen. As shown in FIG. 5, the inner circumference of the guide tube is provided with conveying means, such as a conveying spiral 25. The reject in turn is conveyed to the discharge end of the inner cylinder so that it can fall into the common reject chamber 13. If needed, the rejected fractions from the different screen cylinders can be conducted separately to subsequent process steps, as shown in FIG. 7. Furthermore, water can be fed into the inner cylinder 6 from a dilution water duct 15 in order to dilute the pulp mixture. As it is well known, dilution of the pulp usually facilitates screening. The dilution water simultaneously purifies the screen surface of the screen cylinder and ensures efficient screening. Further, broken lines in the figure show a partition 31, which divides the outer cylinder into two or more sections in the longitudinal direction, if such a structure is advantageous for the screening.

Figure 3:
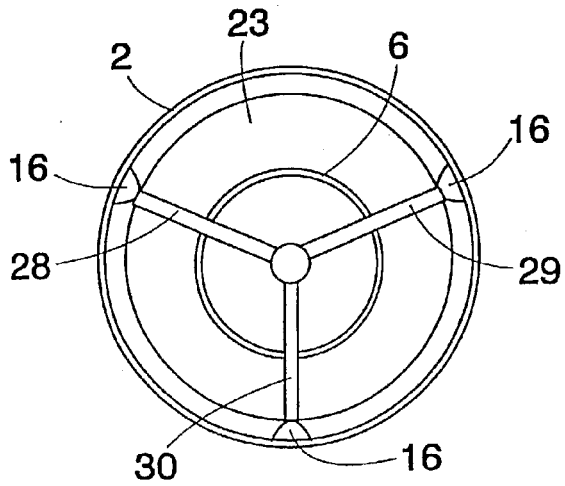
FIG. 3 shows schematically screen cylinders placed one within the other and viewed from direction A.

FIG. 3 shows a manner of supporting the components placed one within the other in the screen, viewed from direction A. Both the inner screen cylinder 6 and the guide tube 23 are supported, via support elements 28, 29 and 30, on conveying blades 16 provided on the inner circumference of the outer screen cylinder 2. The supporting elements can naturally also be different, but advantageously the inner screen cylinder and the guide tube are supported on the outer screen cylinder. Correspondingly, the rear end of the inner cylinder and the guide tube can rest on the end of the outer cylinder or on a suitable support surface that is also common to the outer cylinder. The support means used should not substantially hinder the flow of pulp inside the screen cylinders.

FIG. 4 shows a preferred embodiment of the inner cylinder 6. This is a slotted cylinder the circumference of which is formed by coiling a ribbon 26 into a spiral. The spiral has a certain pitch, and slots 27 are provided between loops of the spiral. The spiral is usually supported by support means provided on the circumference in the longitudinal direction of the cylinder. Alternatively, a slotted cylinder can be formed by means of bands, such that ribbons are arranged side by side on the circumference of the bands in the longitudinal direction of the cylinder and a slot remains between adjacent ribbons. A slotted cylinder has a far greater area of open surface than a hole cylinder, which makes the slotted cylinder very efficient in view of its size. Apertures in the outer screen surface intended for screening of a coarse pulp mixture typically have a size of 10 to 15 mm in a hole cylinder and 5 mm in a slotted cylinder. Correspondingly, the size of apertures in the inner screen surface intended for screening medium coarse pulp typically varies from 5 to 8 mm in a hole cylinder and from 3 to 5 mm in a slotted cylinder. The figure also shows that the front end of the inner screen cylinder is closed by an end section 12.

FIG. 5 shows the cross-section of a guide tube 23 arranged between the outer and the inner screen cylinder. In this case the guide tube is conical and it is intended to be arranged in the screen such that the greatest diameter thereof is situated at the front end of the screen. FIG. 5 shows that the outer circumference of the guide tube is smooth, so that the pulp provided inside the outer cylinder does not adhere to it. When the pulp is lifted by means of the conveying blades and it drops on the cone's surface at the end, the pulp flows easily down the sloping outer surface of the cone towards the discharge end. Furthermore, due to the conical shape the rinsing water that enters the outer screen cylinder during the cleaning thereof carries the rather dry pulp provided at the end of the cylinder towards the discharge end. The inner circumference of the guide tube 23 preferably comprises a conveying element, such as a conveying spiral 25, which conveys the accept from the inner cylinder towards the front end of the screen. The guide tube can also be shaped such that it has a constant inner diameter but the outer diameter is greater at the front end than at the rear end. Also in such a case the cone has a sloping outer surface. In some cases the space between the screen cylinders can also be provided with a tube that has an equal outer and inner diameter. In the embodiments shown in FIGS. 1 and 2 the guide tube is preferably made at least approximately equal in length to the inner screen cylinder, so that it is easier to arrange the front ends of the guide tube and the inner screen cylinder to be supported on the inner circumference of the outer screen cylinder. The screening can be adjusted by changing the length of the guide tube. However, the guide tube should conduct the accept from the inner cylinder a sufficient distance towards the front end of the outer cylinder, so that the accept is able to pass the outer screen surface and does not flow with the reject to the discharge end.

Figure 6:
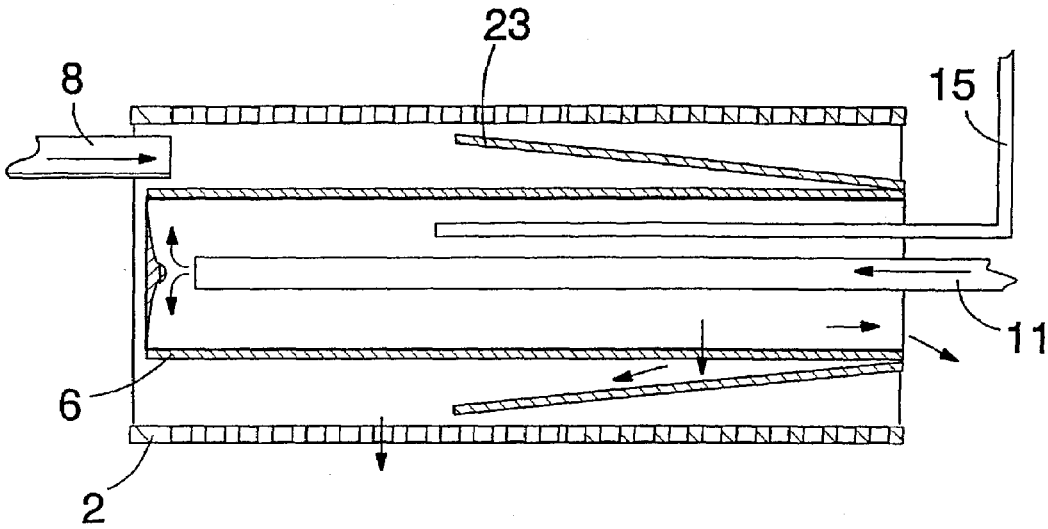
FIGS. 6 and 7 are schematic side views of the operating principle of some screen constructions.

In FIG. 6, the inner screen cylinder 6 corresponds substantially in length to the outer screen cylinder 2. The guide tube 23 extends from the discharge end approximately to the middle of the screen. The length of the guide tube is designed most suitably for the pulp to be screened and the structure of the screen.

In FIG. 7 the screen cylinders partly overlap one another. The cylinders do not have to be positioned at all one within the other. Furthermore, the second or the latter screen cylinder can even be longer than the first screen cylinder. The guide tube conveys the accept from the latter screen cylinder to the first screen cylinder to a point that is advantageous for screening. FIG. 7 further shows a common accept recovery basin 17 and separate reject chambers 13*a* and 13*b*.

The drawings and the related description are only intended to illustrate the inventive idea. The details of the invention may vary within the scope of the claims. Therefore, unlike shown in FIGS. 1 and 2, a slotted cylinder can be provided outermost and a hole cylinder innermost, or both cylinders can be either slotted or hole cylinders. Furthermore, the dimensions of the cylinders and the proportions thereof with respect to one another as well as the number of the required screen cylinders are selected according to current screening requirements.

That which is claimed:

1. An apparatus adapted to screen a plurality of pulp mixtures, said apparatus comprising:

a second screen rotatable about a longitudinal axis thereof and adapted to receive a second pulp mixture into a second screen input end thereof, the second screen having a second screen discharge end axially opposing the second screen input end and a cylindrical screen body defining at least one opening configured to allow an accepted fraction of the second pulp mixture to pass therethrough while retaining a rejected fraction of the second pulp mixture within the screen body and directing the rejected fraction of the second pulp mixture toward the second screen discharge end;

a first screen rotatable about a longitudinal axis thereof and adapted to receive a first pulp mixture into first screen input end, the longitudinal axis of the first screen being coincident with the longitudinal axis of the second screen, the first screen having a first screen discharge end axially opposing the first screen input end and a cylindrical screen body defining at least one opening configured to allow an accepted fraction of the first pulp mixture and the accepted faction of the second pulp mixture to pass therethrough while retaining a rejected fraction of the first pulp mixture within the screen body and directing the rejected fraction of the first pulp mixture toward the first screen discharge end, the second screen being oriented so as to have the second screen input end directed toward the first screen input end; and a guide tube operably engaged with and extending about the second screen so as to be rotatable therewith and extending from the second screen discharge end into the first screen through the first screen discharge end and toward the first screen input end, the guide tube being adapted configured to direct the accepted fraction of the second pulp mixture into the first screen toward the first screen input end such that the first screen screens the first pulp mixture and the accepted fraction of the second pulp mixture, the guide tube and the first and second screens thereby being adapted to cooperate to concurrently screen a plurality of pulp mixtures as the first and second screens are rotated and the first and second pulp mixtures are received in the respective screen.

2. An apparatus according to claim 1 further comprising a rotator operably engaged with at least one of the first screen and the second screen and configured to rotate the at least one of the first screen and the second screen about the respective longitudinal axis thereof.

3. An apparatus according to claim 1 further comprising a feed pipe operably engaged with each of the first and second screens, the feed pipe operably engaged with the first screen being configured to feed the first pulp mixture to the first screen, and the feed pipe operably engaged with the second screen being configured to feed the second pulp mixture to the second screen.

4. An apparatus according to claim 1 wherein the second screen input end is closed and the second screen further comprises a feed pipe extending through the second screen discharge end toward the closed second screen input end, the feed pipe being configured to direct the second pulp mixture at a high pressure toward the closed second screen input end, the closed second screen input end being further configured to substantially evenly direct the second pulp mixture radially outward toward the screen body.

5. An apparatus according to claim 1 further comprising a recovery basin operably engaged with the first screen and configured to collect the accepted fractions of the first and second pulp mixtures therein.

6. An apparatus according to claim 1 further comprising at least one reject chamber configured to collect the rejected fractions of the first and second pulp mixtures from the first screen and second screen discharge ends respectively.

7. An apparatus according to claim 1 further comprising at least one conveying blade disposed adjacent to an inner surface of the screen body of the first screen, the at least one conveying blade being stationary and configured to direct the first pulp mixture toward the first screen discharge end when the screen body is rotated.

8. An apparatus according to claim 1 wherein the screen body of the second screen comprises a spirally-wound ribbon configured to move the second pulp mixture toward the second screen discharge end when the screen body is rotated.

9. An apparatus according to claim 1 further comprising at least one jet pipe operably engaged with at least one of the first and second screens, the at least one jet pipe being configured to direct a water spray at the screen body of the at least one of the first and second screens so as to clean the screen body.

10. An apparatus according to claim 1 wherein the second screen is further configured to at least partially extend into the first screen through the first screen discharge end.

11. An apparatus according to claim 1 wherein the second screen is further configured to at least partially extend into the first screen through the first screen discharge end the guide tube is coaxially disposed between the first and second screens.

12. An apparatus according to claim 1 wherein the guide tube further comprises a conical outer surface having a major diameter end, the guide tube being disposed with respect to the first screen such that the major diameter end is toward the first screen input end.

13. An apparatus according to claim 1 further comprising a feed conduit operably engaged with and extending into the second screen so as to provide water thereto.

14. An apparatus according to claim 1 wherein the second screen is disposed within the first screen such that the respective first screen and second screen discharge ends are in registration, the second screen extending toward the input end of the first screen.

15. An apparatus according to claim 1 further comprising at least one support element operably engaged between the first and second screens and configured to support the first screen in coaxial relation with the second screen.

* * * * *

UNITED STATES PATENT AND TRADEMARK OFFICE

CERTIFICATE OF CORRECTION

PATENT NO. : 7,097,740 B2
APPLICATION NO. : 10/411400
DATED : August 29, 2006
INVENTOR(S) : Vuorinen It is certified that error appears in the above-identified patent and that said Letters Patent is hereby corrected as shown below:

Column 4,
Line 56, "course" should read --coarse--.

Column 7,
Line 58, after "being" cancel "adapted".

Column 8,
Line 53, after "end" insert --and--.

Signed and Sealed this

Thirteenth Day of February, 2007

JON W. DUDAS
*Director of the United States Patent and Trademark Office*